United States Patent [19]

Hathaway

[11] 4,139,131

[45] Feb. 13, 1979

[54] CHILD CARRIER HAVING ENVELOPING STRUCTURE AND SUSPENSION STRAP

[76] Inventor: Sandra J. Hathaway, 303 Kohr Rd., Kings Park, N.Y. 11754

[21] Appl. No.: 801,538

[22] Filed: May 31, 1977

[51] Int. Cl.[2] ..... A63G 9/00

[52] U.S. Cl. ..... 224/6; 224/8 R; 297/275; 297/385

[58] Field of Search ..... 224/6, 5 N, 5 Q, 5 BC, 224/11, 8 R; 297/384, 385, 389, 275

[56] References Cited

U.S. PATENT DOCUMENTS

| | | | |
|---|---|---|---|
| 1,397,161 | 11/1921 | Clemetson | 224/8 R |
| 1,586,058 | 5/1926 | Winfield | 224/8 R |
| 2,597,948 | 5/1952 | Phillips | 224/6 |
| 3,575,326 | 4/1971 | Chappell | 224/6 |
| 3,780,919 | 12/1973 | Hansson | 224/6 |
| 4,037,764 | 7/1977 | Almoshino | 224/6 |

*Primary Examiner*—Trygve M. Blix
*Assistant Examiner*—Sherman D. Basinger
*Attorney, Agent, or Firm*—Edward H. Loveman

[57] ABSTRACT

A child carrier comprises an enveloping structure defining a pocket with open top, closed sides and partially closed bottom. A long suspension strap is secured to the enveloping structure at the bottom of the pocket. The strap may be partially padded and has two free end sections for engagement upon an external support. The enveloping structure includes a generally rectangular body which forms sides and back of the pocket, an elongated crotch piece, and a rectangular body piece which forms the front of the pocket. A cross member on the rectangular body has laterally spaced passageways to guide the free end sections of the strap which are then passed around a support and through a loop secured to the bottom of the enveloping structure.

12 Claims, 14 Drawing Figures

CHILD CARRIER HAVING ENVELOPING STRUCTURE AND SUSPENSION STRAP

The present invention relates to the art of infant and child carriers and more particularly concerns an improved, wholly flexible, soft, shoulder suspended carrier for babies and larger children.

There has been an increasing interest in shoulder suspended child carriers for several reasons. First, there has been a greatly increased interest in hiking, camping and backpacking activities and young parents frequently enjoy taking their babies along. In addition, there is widespread interest in doing things the "natural way" which along with a renewed interest in breast feeding, goes interest in the importance of close holding, and the recognition that the warmth, motions and sounds of the mother's body help to comfort the often fussy newborn who has so recently made transition from womb to world. Also, parents who would have been tense and frustated by an incessantly crying, fussy baby often find that with the use of an infant carrier they have a happier, more contented child and therefore they have more peace of mind and confidence in themselves. At the same time while carrying the child, their hands may be free to tend to the needs of other children or to carry on other activities.

There are many shoulder suspended carriers available but they all have one or more of the following disadvantages:

1. The carrier is too bulky and/or has a rigid frame that is frequently uncomfortable for the child and for the person carrying the child.
2. The carrier is unnecessarily heavy for the person carrying the child.
3. The carrier has straps which chafe against the child's head.
4. The carrier straps bind or pull against parts of the child's body.
5. The carrier is designed only for infants up to a few months old and cannot accommodate older children.
6. The carrier fails to provide support for the infant's head so that it cannot be used for a newborn baby as yet unable to support its own head.
7. The carrier must be unstitched to accommodate a growing child.
8. The carrier is loosely constructed so that it does not sufficiently prevent the possibility of the child's slipping through side openings in the carrier.
9. The carrier is complicated to fasten and adjust, or to figure out how to use it.
10. The carrier is too difficult to load and unload, either the child into the carrier or the carrier onto the person carrying the child.
11. The carrier cannot be easily and quickly washed and dried.
12. The carrier encloses the child too completely so that the child is uncomfortably warm.
13. The carrier is too flimsy and wears out quickly.
14. The carrier is complicated to manufacture and is very expensive to purchase.

The present invention is directed at overcoming or avoiding the above and other difficulties and disadvantages, and in addition has many improved features.

According to the invention, there is provided a soft, flexible carrier made of cloth. It has a body enveloping portion or enclosure which receives the child and includes a pocket with leg openings. The enveloping portion may be adjusted laterally by means of slide fasteners to fit the child's waist, and may be adjusted longitudinally by means of a foldable flap to fit the child's height and head support requirements. The child is supported in seated position in the enveloping portion which in turn is supported by a novel, long suspension strap attached to the enveloping portion. The suspension strap may be arranged in relation to the enveloping portion in a variety of ways enabling the carrier to be used optionally for carrying on the front or back of a person, or for securing the child in a chair, or on a bed. Also the carrier may be suspended from an overhead support for use as a swing or exerciser.

The carrier embodying the present invention is made of soft, flexible, lightweight cloth fabric material. The fabric may have a soft nap or it can have an open or closed weave. It may have eyelets for greater ventilation. The carrier includes one long main strap which is a tubular cloth body filled with soft padding material for most of its length, but unfilled and flattened at its ends. The strap is secured at its center to the bottom of the enveloping section. This bears the weight of the child in a sitting position as if the user's arm were placed beneath the child's bottom in a natural arm carrying position. The portions extending from the center of the suspension strap, distribute the weight of the child evenly. The padded strap portions pass over the shoulders of the user and are crossed at the user's back for front carrying, or are crossed at the front for back carrying. The end portions of the strap pass through a loop at the center of the bottom of the enveloping section with the flat free end portions tied together under the loop to provide a lightweight, washable, absolutley slip-proof, safe support for the child.

It is, therefore, a principal object of the present invention to provide an infant or child carrier such that the carrier is completely comfortable for both the child and user, and which supports the child in such a way as to simulate natural close holding of the child in the arms of an adult.

It is another object of the present invention to provide a child carrier which affords high head support for a newborn baby and which provides more of an enclosure for the very small baby, making transition from the womb to the world a less abrupt change.

A further object of the present invention is to provide a child carrier which holds a yound baby in a position where when its head rests against the body of the user, the baby can be comforted by the heartbeat sound to which the baby was accustomed prior to birth.

Still another object of the present invention is to provide a child carrier having such proportions that it is self-adjusting and becomes less confining as the child grows and as the child becomes able to hold up its own head.

A still further object of the present invention is to provide a child carrier which leaves the hands and arms of the user completely free, so that household chores may be done and so that walking is easy and unimpeded.

Yet another object of the present invention is to provide a carrier which is light in weight, and which may be entirely constructed of soft materials in both winter-warm and summer-cool fabrics and which is free of hardware and extra straps can be easily washed and dried and which may be readily manufactured by mass production methods so that it is easy to use and is durable and long lasting in service.

Yet a further object of the present invention is to provide an all fabric child carrier having a generally rectangular fabric body with a cross strap formed with vertical passageways near the top to engage a suspension strap, and with a small centered loop at the bottom through which the suspension strap passes, with a vertical crotch piece extending from the small loop and terminating in a large loop and a rectangular piece is engaged in the large loop and has slide fastener strips engageable with slide fastener strips on lateral edges of the envelope body with the padded suspension strap secured at its center to the bottom of the envelope body and extending outwardly, with long padded intermediate positions, and free flat end portions provided with buttonholes which may be engageable on a button at the center of the suspension strap inside the small loop.

These and other objects and many of the attendant advantages of this invention will be readily appreciated as the same becomes better understood by reference to the following detailed description when considered in connection with the accompanying drawings in which.

Figure 3:
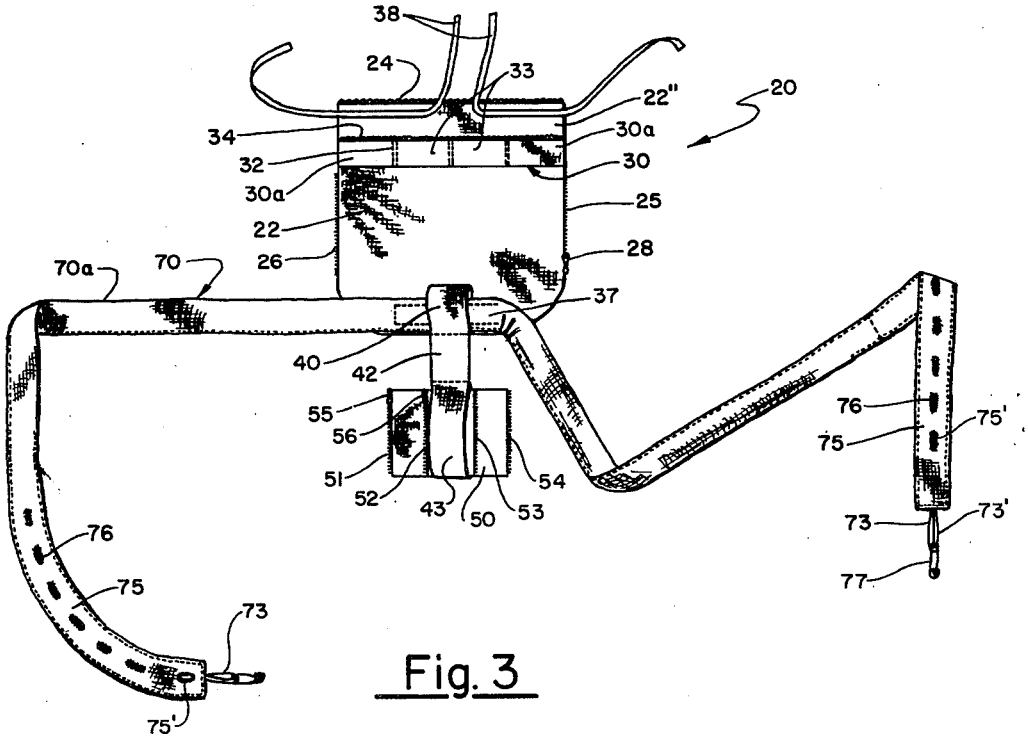
FIG. 3 is a rear elevational view of the child carrier shown in wholly open position.
Figure 4:
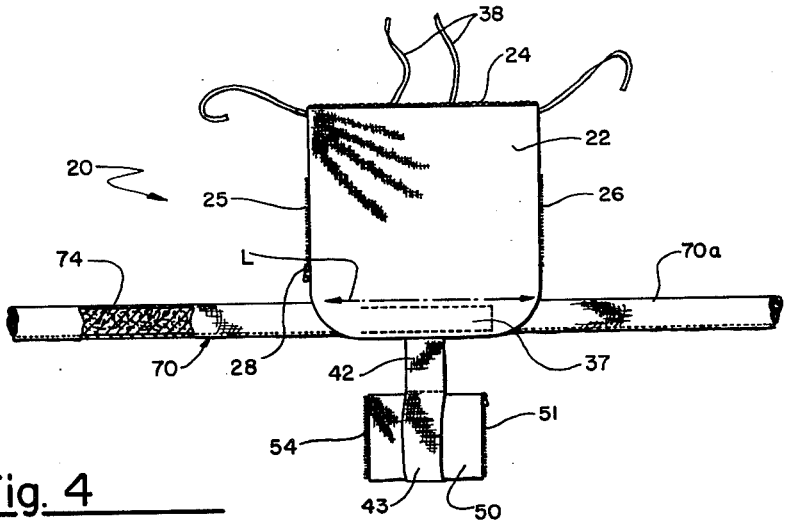
FIG. 4 is a front elevational view of the child carrier in wholly open position but with portions broken away.
Figure 5:
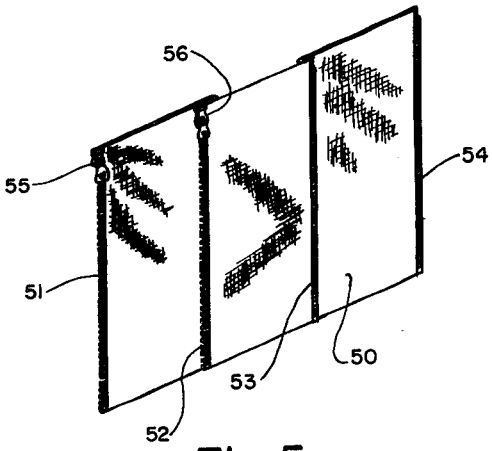
FIG. 5 is an enlarged perspective view of a detachable body piece.
Figure 6:
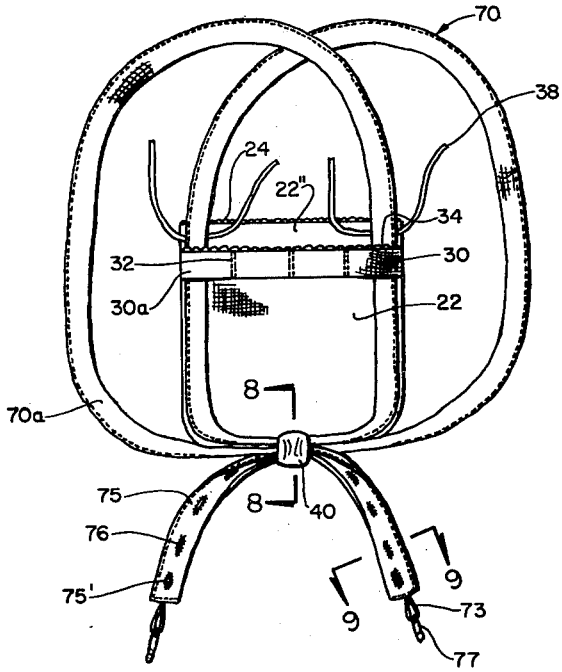
FIG. 6 is a rear elevational view of the child carrier shown arranged for supporting a child with the free ends secured to the button.
Figure 7:
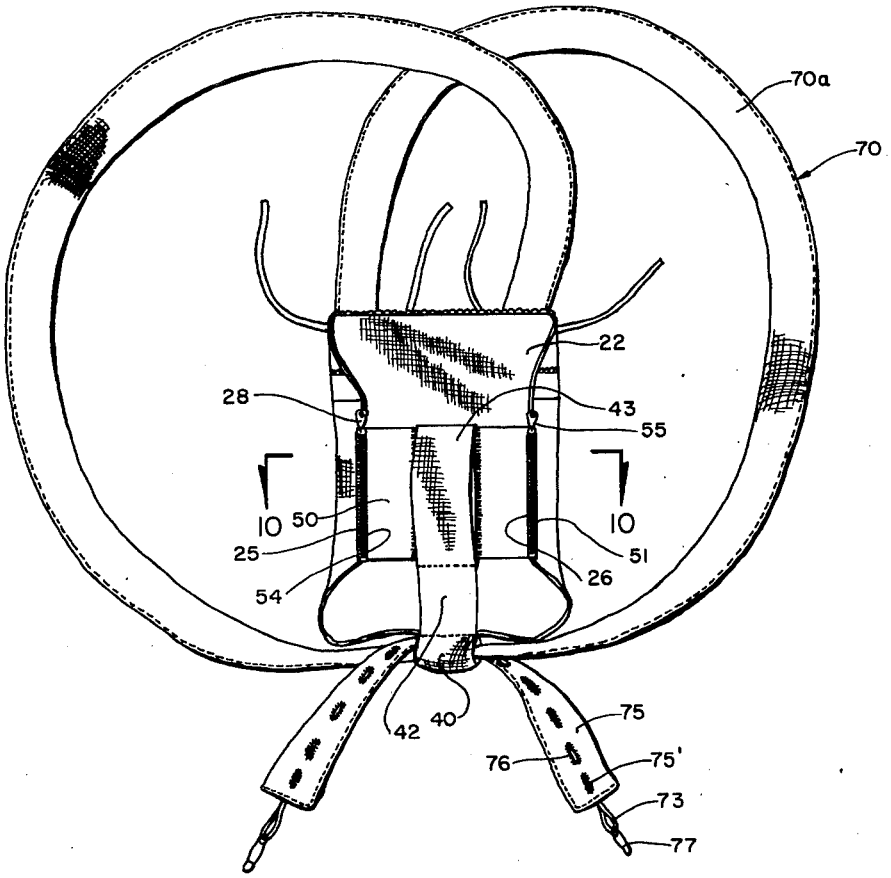
FIG. 7 is a front elevational view similar to FIG. 6 shown arranged for supporting a child.

Referring now to the drawings wherein like reference characters designate like or corresponding parts throughout, there is illustrated in FIGS. 3 and 4, a child carrier generally designated as reference numeral 20 having a generally rectangular cloth body 22 with a straight top, side and bottom edges, and with curved bottom corners. A lacy edging 24 may be provided at the top edge. Slide fastener strips 25, 26 are provided at lateral vertical edges. The strip 25 is provided with a slider 28. A cross strap 30 is secured to body 22 by laterally spaced vertical lines of stitching 32 to define a plurality of vertical passgeways. The strap 30 may also be finished with a decorative lacy edging 34. Two tapes 38 may be secured by stitching at their centers to the body 22 near its upper corners. At the bottom of the body 22 is secured a loop 40 and extending therefrom is a narrow crotch piece 42 doubled to form a large loop 43. A detachable rectangular piece 50 (best shown in FIG. 5) is inserted through the loop 43 parallel to the body 22 and has four laterally spaced vertical slide fastener strips 51–54. Adjacent strips 51, 52 have respective sliders 55, 56 which are respectively selectively engaged to the strip 26. The slider 28 is respectively selectively engaged by either the strip 53 or 54, when the crotch piece 42 is folded. Thus when the carrier is assembled, as shown in FIGS. 6, 7, the slide fastener strip 26 is engaged with either the strip 51 or 52, and the strip 25 is engaged with either the strip 53 or 54. If the strips 26, 25 are engaged with the outer strips 51, 54, respectively, the envelop body provides a large pocket for receiving the child while engagement of the strips 26, 25 with the inner strips 52, 53, respectively, provides a small pocket. If desired the strip 26 may be engaged with the outer strip 51 and the strip 25 with the inner strip 53 to provide an intermediate size pocket.

Figure 10:
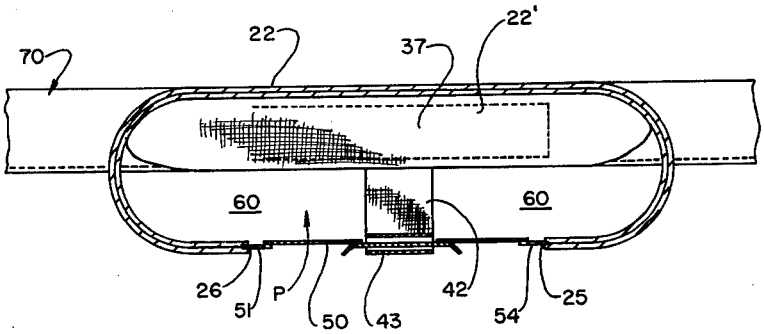
FIG. 10 is an enlarged horizontal sectional view taken along line 10—10 of FIG. 7.

A pocket P for receiving and supporting the child is defined when the body piece 50 is secured to the body piece 22 as shown in FIG. 10. Then a bottom portion 22' of the body 22 is turned horizontally to define a seat while openings 60 are provided for the legs of the child. The openings 60 are defined between the crotch piece 42, and the body 22 at the back and sides and the body piece 50 at the front.

Figure 8:
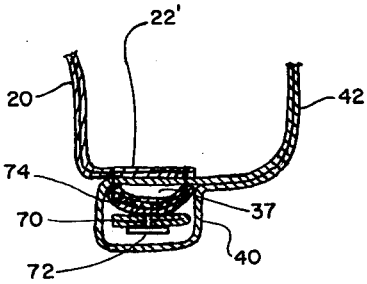
FIG. 8 and FIG. 9 are fragmentary enlarged sectional views taken along lines 8—8 and 9—9 respectively of FIG. 6.
Figure 9:
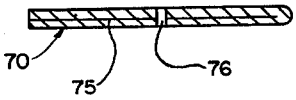

A long suspension strap 70 is an integral part of the carrier, and may be about four yards in length. It is secured by stitching at its center to the bottom body seat portion 22' inside the loop 40. As illustrated in FIGS. 4 and 8, the strap is stitched on three sides (FIG. 4) to form a pocket 37. If desired a reinforcing member (not shown) made of fiber board or the like may be inserted into the pocket 37 to form a rigid seat 22'. A button 72 is secured to the strap 70 inside the loop 40 as shown in FIG. 8. The suspension strap 70 is tubular in form and for about two and a half yards of an intermediate section 70*a* it is filled with a soft, resilient padding 74, as shown in FIGS. 4 and 8. The outer free end portions 75 of the strap are flattened, unpadded, and are provided with buttonholes 76, one of which may be selectively engaged with the button 72, when the carrier 20 is arranged to support a child as shown in FIGS. 1, 2, 6 and 7. Small tape loops 73 may be provided at the free end portion 75 of the strap 70. A conventional safety pin 77 may be secured to the free end 73' of each of the loops 73 for a purpose which will be more fully described below. If desired an aperture 75' (FIG. 3) may be provided at each end portion 75 through one tubular wall of the strap 70 in which the pin 77 may be placed when not in use as illustrated in FIG. 2.

Figure 1:
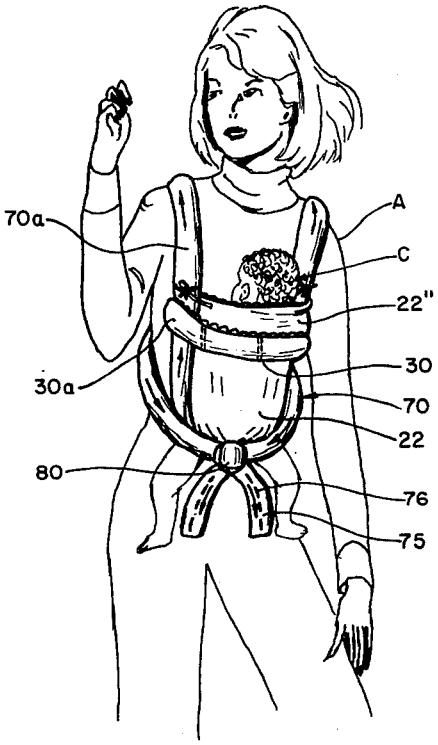
FIG. 1 is a diagrammatic oblique rear and side view of the child carrier embodying the invention and shown mounted at the front of person using the carrier and carrying a young baby with its head fully supported.
Figure 2:
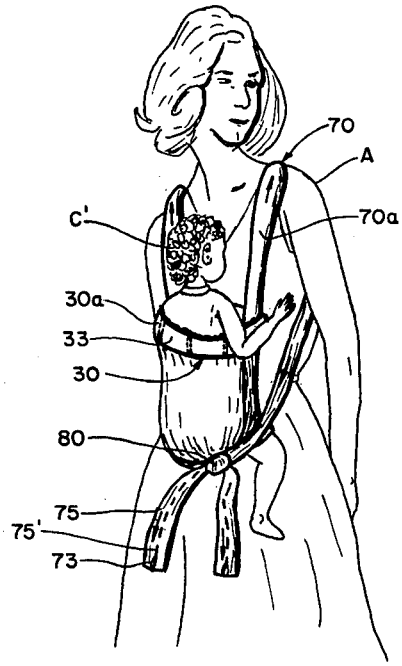
FIG. 2 is another diagrammatic oblique rear and side view of the child carrier supporting an older baby at the front of the user with the upper part of the carrier body turned down to clear the head and arms of the baby.

To arrange the carrier 20 for supporting a child C or C' at the front of a user A as shown in FIGS. 1 and 2, the padded strap portions 70*a* are first passed upwardly through outer passageways 30*a* of the cross piece 30 as best shown in FIG. 6. Then the padded strap portions 70*a* are crossed at the back of the user and brought down and forwardly as shown in FIGS. 1 and 2. Then the flat unpadded outer free end portions 75 are passed through the loop 40 and the free ends of the strap may be tied together to form a knot 80 shown in FIGS. 1 and 2 underneath the child. If desired each free end 75 may have one of its respective buttonholes 76 secured to the button 72. It will be noted that the body portion 22 and the strap 70 define a padded seat for the child. The free ends of tapes 38 may be secured around the straps 70*a* to maintain an upper body portion 22" extended as shown in FIG. 1. If desired, the upper body 22" may be turned downwardly out of sight inside the body portion 22 as shown in FIG. 2 depending on the height of the child and its need for head support.

Figure 11:
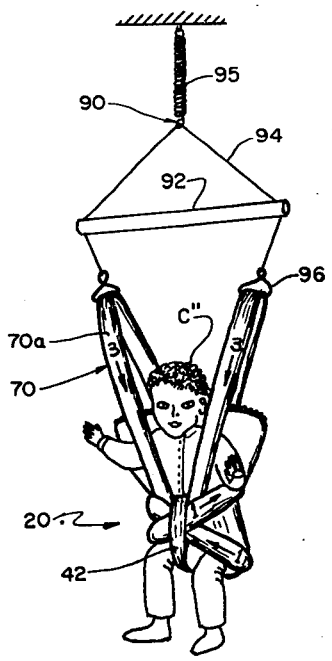
FIG. 11 and FIG. 12 are front and rear diagrammatic views respectively of the child carrier used as a swing or exerciser.
Figure 12:
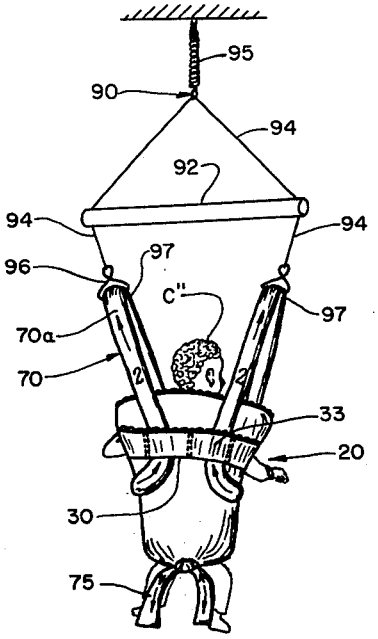

In FIGS. 11 and 12 the carrier 20 is shown arranged to support the child C" as a swing or exerciser 90. This swing includes a horizontal bar 92 with a cord 94 suspended from a spring 95. The cord 94 has knotted loops 96, or hooks (not shown) at its end engaging the strap sections 70*a*. In this arrangement, strap sections 70*a* are first crossed at the front of the child through the loop 43 as shown at points #1, FIG. 11. The strap portions 70*a* are then passed up through the inner passageways 33 of the cross strap 30, as shown in FIG. 12, at points #2. Then the padded strap portions 70*a* are formed into loops 97 and the free ends 75 extend down the front of the child and under the cross straps of points 1 and through the loop 40 where the free ends 75 may be tied in a knot. The ends of the cord 94 are then passed through the loop 97 to form the loop 96.

Figure 13:
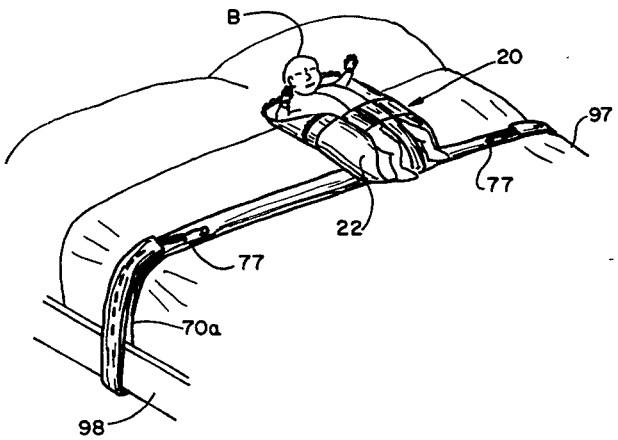
FIG. 13 is a perspective view of the carrier holding a baby on a bed.

In FIG. 13, a yound child B is enclosed in the carrier 20. The child B lies on a bed 97 with the strap portions 70*a*, extending laterally and engaged around lateral bed boards 98. Flat end portions 75 of the strap are then secured by the pins 77. If desired the flat end portions 75 may be pinned to other points of the bedding.

Figure 14:
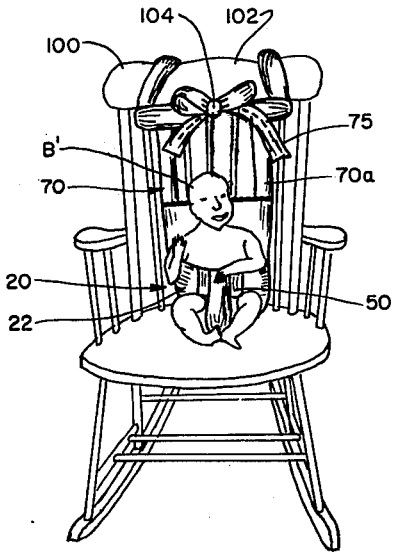
FIG. 14 is a front view of the carrier supporting a child seated in a chair.

In FIG. 14 the child B' is shown supported in a seated position in the carrier 20 on a chair 100. In this arrangement padded strap portions 70*a* are passed upwardly and around an upper rail 102 to the back of the chair 100. Then the free ends 75 of the strap 70 are brought to the front of the chair and ar tied by a bowknot 104 at the top of the chair 100.

Various modifications are possible in the basic carrier described above. For example portions of the body 22 and the body piece 50 may be padded with a lightweight soft padding such as polyester padding or polyurethane foam. Similar padding may be used in suspension strap 70. If an open weave fabric is used for the body 22 it may be reinforced at points of possible strain with a suitable more closely woven fabric.

It should be understood that the foregoing relates to only a preferred embodiment of the invention, and that it is intended to cover all changes and modifications of the example of the invention herein chosen for the purposes of the disclosure, which do not constitute departures from the spirit and scope of the invention.

The invention claimed is:

1. A child carrier, comprising:

an enveloping structure defining a pocket with an open top, closed sides, and a partially closed bottom, to receive, surround, support and secure the body of a child, said enveloping structure having a back body, a crotch piece and a front body;

one long suspension strap attached at a central section thereof to only a portion of said back body of said enveloping structure to support the same, said strap having two free end sections, each of said free end sections extending in opposite directions parallel to the bottom edge of said back body; and passage means on said enveloping structure for providing a passage through which said free end sections of said suspension strap may be directed vertically along the outside of said enveloping structure to engage around an external support.

2. A child carrier as defined in claim 1, wherein said enveloping structure includes adjustment means for adjusting said pocket in width to accommodate children of different waist sizes.

3. A child carrier as defined in claim 1, wherein said enveloping structure and said suspension strap are made of soft, strong, flexible, washable, lightweight, fabric material.

4. A child carrier as defined in claim 1, wherein said enveloping structure comprises:

a flat, flexible, generally rectangular back body;

an elongated flexible crotch piece secured to and extending beyond a bottom edge of said back body; and a generally rectangular flat, flexible front body engaged with said crotch piece, whereby a bottom part of said back body is folded forwardly to define a seat for said child at said bottom of said pocket and said crotch piece, said front body and said back body together defining leg openings for said child, said front body defining a front of said pocket, and said back body defining a back and sides of said pocket, whereby the legs of said child may protrude downwardly through said leg openings and the upper torso, arms and head of said child may protrude upwardly beyond said open top of said pocket.

5. A child carrier, as defined in claim 4, further comprising a loop on the outside of said seat for engaging said free end sections of said strap when passed therethrough.

6. A child carrier, as defined in claim 5, further including a button secured to said strap inside said loop and wherein the free ends of said strap are provided with buttonholes for selective engagement with said button.

7. A child carrier as defined in claim 4, wherein said front body and said back body have mutually engageable and quick disengageable attachment means to form said pocket.

8. A child carrier, as defined in claim 7, wherein said attachment means comprises first slide fastener strips secured to side edges of said back body, and a plurality of laterally spaced other fastener strips secured to said front body, and selectively engageable with said first slide fastener strips for adjusting the cross sectional size of said pocket.

9. A child carrier, as defined in claim 4, wherein said crotch piece is formed with a large loop to receive said front body with lateral portions of said front body extending outwardly beyond said crotch piece loop.

10. A child carrier, as defined in claim 4, wherein said back body has a portion extending upwardly beyond said front body to serve as a head support at the back of said child, and foldable downward inside said pocket when said head support is not required.

11. A child carrier, as defined in claim 1, wherein said passage means comprises a body member secured across said back body and defining vertical passageways spaced laterally across said back body for receiving said free end sections of said strap.

12. A child carrier, as defined in claim 11, wherein said strap is as much as four yards long and is at least partially filled with padding material to provide a comfortable support for said child under said seat, and to comfortably distribute the weight of said child upon a person carrying said carrier.

* * * * *